US012467338B1

(12) United States Patent
Deng et al.

(10) Patent No.: US 12,467,338 B1
(45) Date of Patent: Nov. 11, 2025

(54) DISAPPEAR-ON-DEMAND MATERIAL ACTUATOR, METHOD AND SYSTEM

(71) Applicant: Baker Hughes Oilfield Operations LLC, Houston, TX (US)

(72) Inventors: Guijun Deng, The Woodlands, TX (US); Vimal Shah, Sugar Land, TX (US); Zhihui Zhang, Katy, TX (US)

( * ) Notice: Subject to any disclaimer, the term of this patent is extended or adjusted under 35 U.S.C. 154(b) by 0 days.

(21) Appl. No.: 18/769,783

(22) Filed: Jul. 11, 2024

(51) Int. Cl.
*E21B 41/00* (2006.01)

(52) U.S. Cl.
CPC ..... *E21B 41/00* (2013.01); *E21B 41/0085* (2013.01)

(58) Field of Classification Search
CPC .. E21B 41/0085; E21B 43/1185; E21B 41/00; E21B 23/00
See application file for complete search history.

(56) References Cited

U.S. PATENT DOCUMENTS 2,944,603 A * 7/1960 Baker ..... E21B 23/06 166/241.5
3,262,389 A * 7/1966 Bryla ..... F42C 19/06 102/202.1
10,167,691 B2 1/2019 Zhang et al.
10,221,641 B2 3/2019 Zhang et al.
10,221,642 B2 3/2019 Zhang et al.
10,221,643 B2 3/2019 Zhang et al.
10,253,590 B2 4/2019 Xu et al.
10,364,630 B2 7/2019 Xu et al.
10,364,631 B2 7/2019 Xu et al.
10,364,632 B2 7/2019 Xu et al.
10,865,617 B2 12/2020 Deng et al.
11,787,991 B1 10/2023 Zhao et al.
2006/0100968 A1* 5/2006 Hall ..... G06Q 30/0283 705/400
2010/0175867 A1* 7/2010 Wright ..... E21B 34/063 166/57
2014/0083689 A1* 3/2014 Streich ..... E21B 34/10 166/250.15
2020/0332615 A1* 10/2020 Wiesenborn ..... E21B 31/107
2023/0184091 A1* 6/2023 Alshaikh ..... E21B 47/01 166/250.11
2023/0258055 A1 8/2023 Zhang et al.
2024/0410272 A1 12/2024 Zhang et al.
2025/0012156 A1 1/2025 Ewing et al.

* cited by examiner

*Primary Examiner* — Brad Harcourt
(74) *Attorney, Agent, or Firm* — Baker Hughes Company

(57) ABSTRACT

A disappear-on-demand material actuator, including a trigger disposed in operable contact with the material, the trigger configured to respond to manipulation of a tubing string in operable communication with the actuator, and an electrical energy source electrically connected to the material and configured to supply electrical energy to the material upon a sequence initiation of the trigger. A method for actuating a disappear-on-demand material, including manipulating a tubing string, changing a trigger on the actuator, and conveying electrical energy to the material.

23 Claims, 12 Drawing Sheets

DISAPPEAR-ON-DEMAND MATERIAL ACTUATOR, METHOD AND SYSTEM

BACKGROUND

In the resource recovery and fluid sequestration industries actuation of devices remotely is a time and cost saver. Disappear-on-demand (DOD) materials, commercially available from Baker Hughes, are very useful when employed as a part of an actuator for a tool. Electrical energy needs merely be supplied to the material and the material will disappear, hence ceasing to be an impediment to something happening that is part of a cascade to actuate whatever tool is being actuated. Actuating DOD material generally is done using surface power or batteries and requires a tether to surface. Such tethers are not always permanent in a borehole and hence there is a limited time during which prior art actuators can be used without an intervention. Interventions are inefficient and costly and accordingly should be avoided where possible. The art will well receive new technologies and arrangements that support this goal.

SUMMARY

An embodiment of a disappear-on-demand material actuator, including a trigger disposed in operable contact with the material, the trigger configured to respond to manipulation of a tubing string in operable communication with the actuator, and an electrical energy source electrically connected to the material and configured to supply electrical energy to the material upon a sequence initiation of the trigger.

An embodiment of a method for actuating a disappear-on-demand material, including manipulating a tubing string, changing a trigger on the actuator, and conveying electrical energy to the material.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
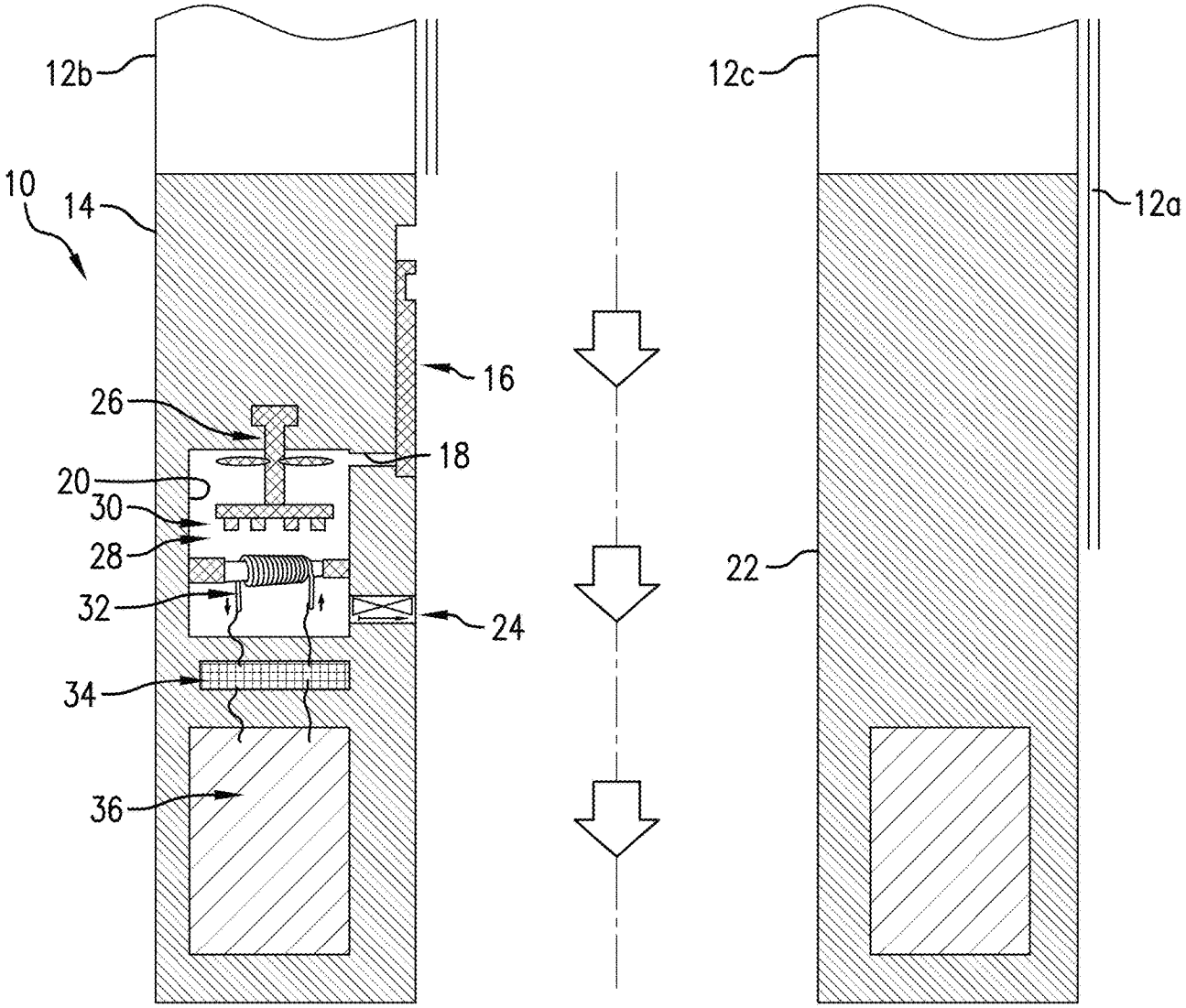
FIG. 1 is a sectional view of a disappear-on-demand material actuator in a static position before actuation.
Figure 1A:
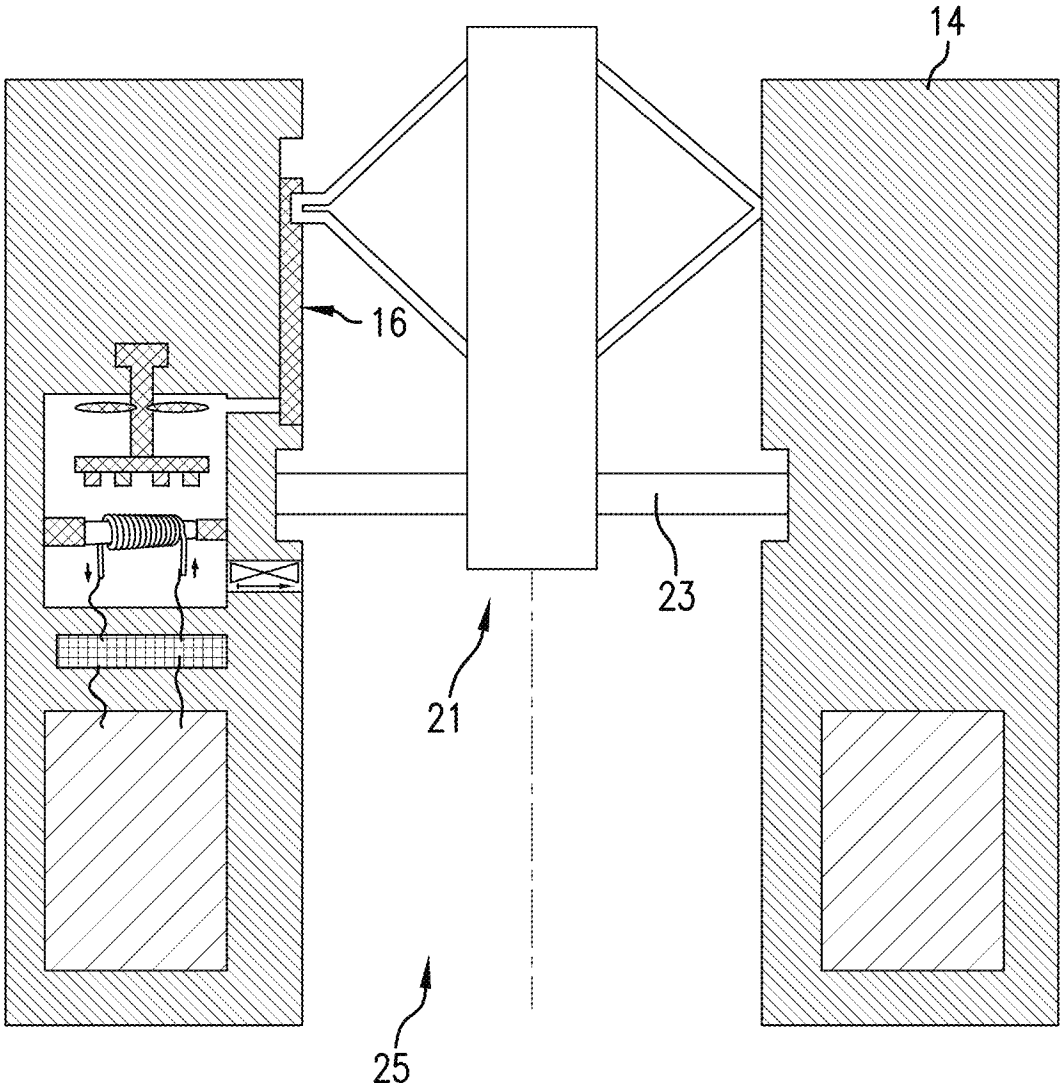
FIG. 1A is the illustration of FIG. 1 with one embodiment of a plug system installed therein.
Figure 2:
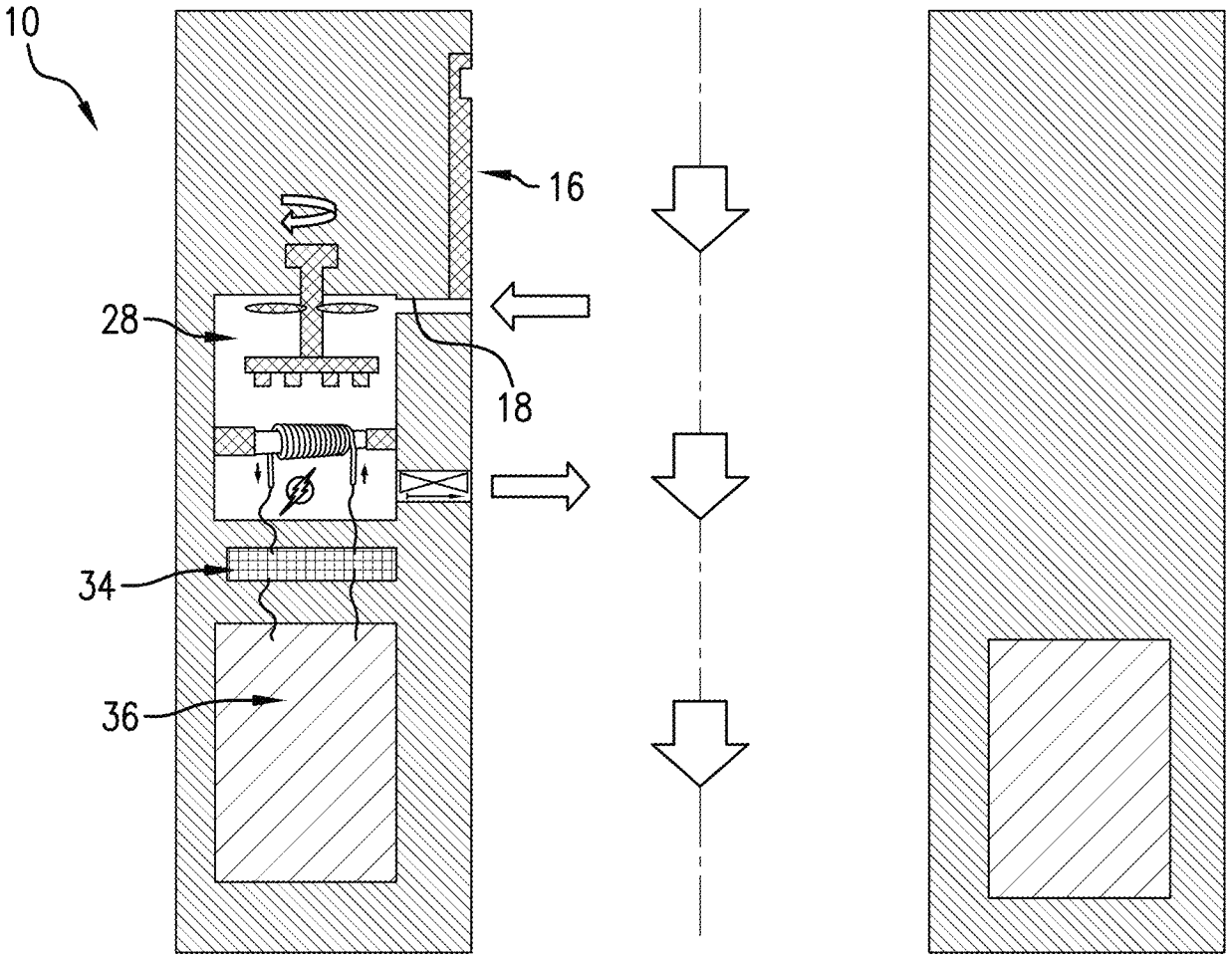
FIG. 2 is the view of FIG. 1 after a member has been moved to allow flow to spin a generator of the embodiment.
Figure 2A:
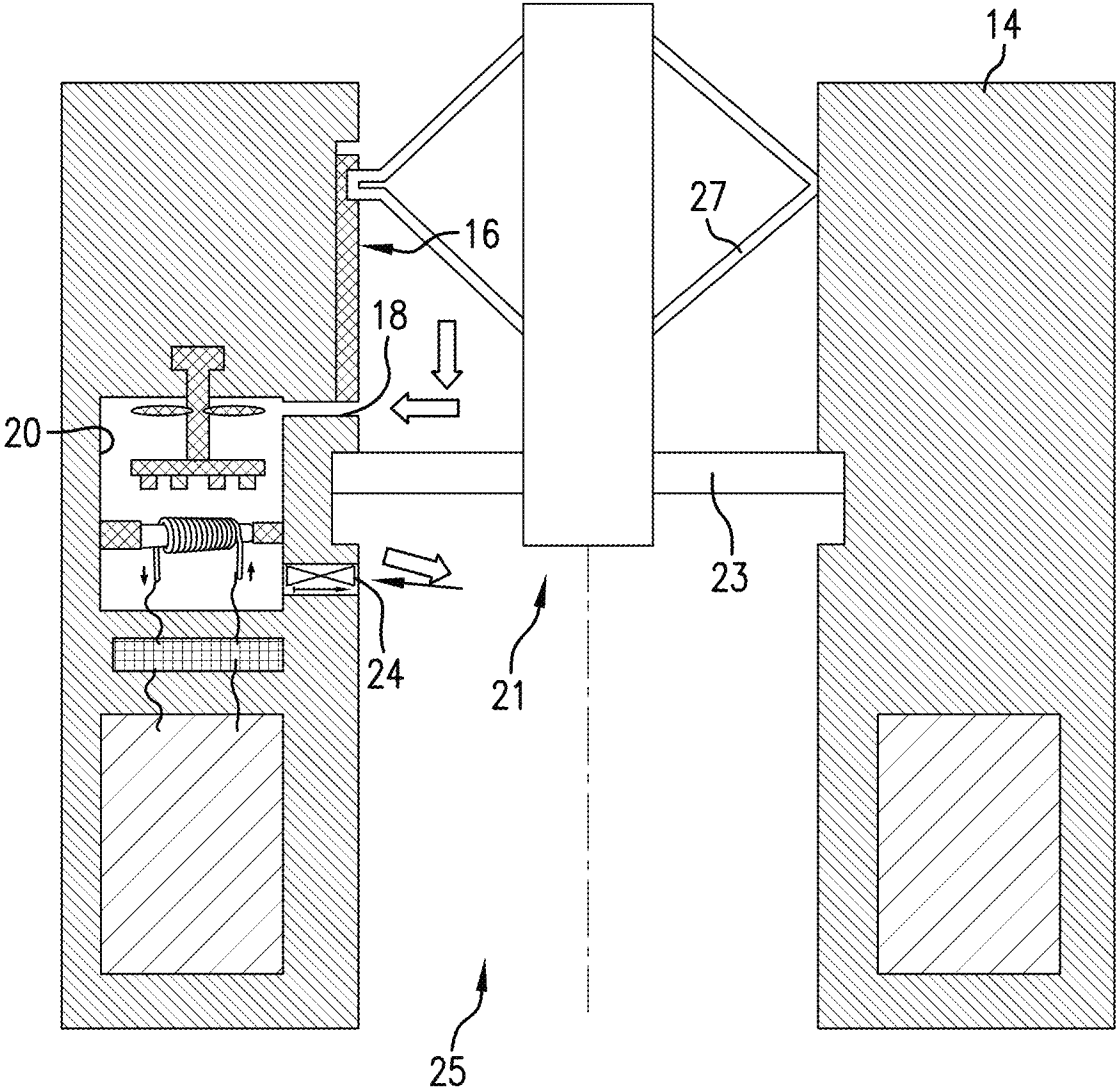
FIG. 2A is the illustration of FIG. 2 with one embodiment of the plug system installed therein shown after the movement illustrated in FIG. 2.
Figure 3:
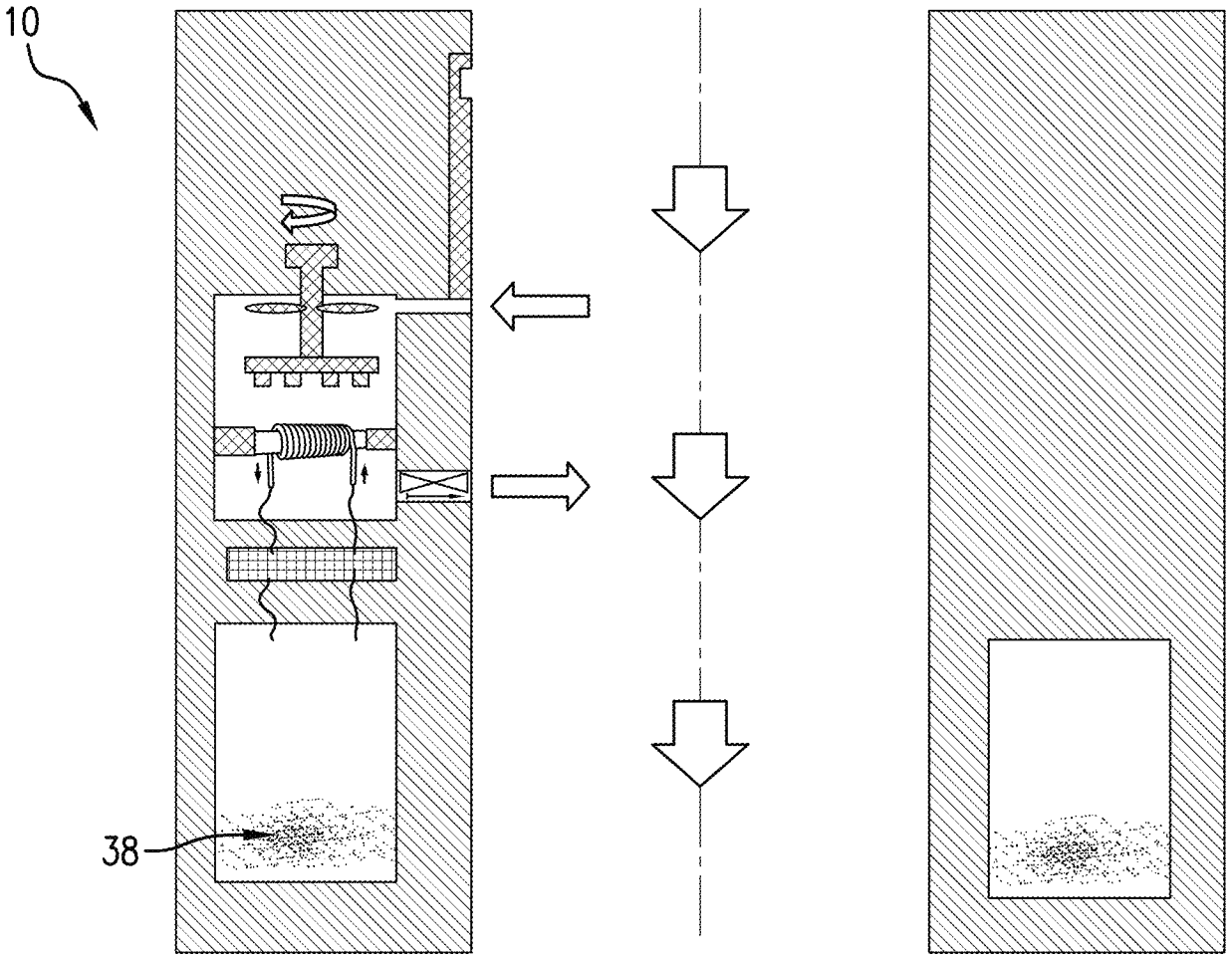
FIG. 3 is the view of FIG. 1 after the actuator has ignited the disappear-on-demand material.

Referring to FIGS. 1-3, a first embodiment of a disappear-on-demand material actuator 10 is illustrated. It will be appreciated that the actuator 10 is disposed within 12a or as a part of 12*b* or may be outside of a string 12*c* that can be manipulated from surface to have an effect on the actuator 10. Accordingly, simple string manipulation is all that is needed to cause the actuation of actuator 10. Interventions are not necessary. Construction of the exemplary actuator 10 illustrated in FIG. 1 uses a string 12*c* for manipulation. The actuator 10 includes a housing 14 that may include or otherwise be associated with a trigger 16. In the embodiment of FIG. 1, the trigger 16 is a sliding sleeve that can be moved to open a port 18 that extends into a chamber 20 within the housing 14. The trigger 16 is movable simply by the manipulation of the string 12*c*. When open, port 18 allows fluid from an inside diameter 22 of the housing 14 (and the string that feeds that area) to flow into the chamber 20 and out a one-way valve 24. The fluid creates a flow stream through the chamber 20. In order to encourage fluid flow through the actuator 10, a plug of some kind is used. One embodiment of a plug system 21 is illustrated in FIG. 1A prior to activation and in FIG. 2A after activation of the actuator 10. A plug 23 is schematically illustrated blocking flow through a main bore 25 of housing 14. The plug 23 may be a ball on seat, a dart on seat, an inflatable, etc. with its purpose being to divert fluid from the main bore 25 through port 18, into chamber 20 and out of one-way valve 24. The plug 23 need not create a full seal but rather simply cause the chamber 20 route to be at least a viable fluid flow route. Fluid always will seek the path of least resistance so a reduction in flow in the main bore will make the chamber route look "attractive" to fluid for flowing therethrough in view of the restricted pathway through the main bore 25 of the housing. The plug system 21 further includes, in some embodiments, a trigger activator 27, again schematically illustrated. Referring to FIG. 2A relative to FIG. 1A, will make the action of the system 21 quite apparent.

Figure 4:
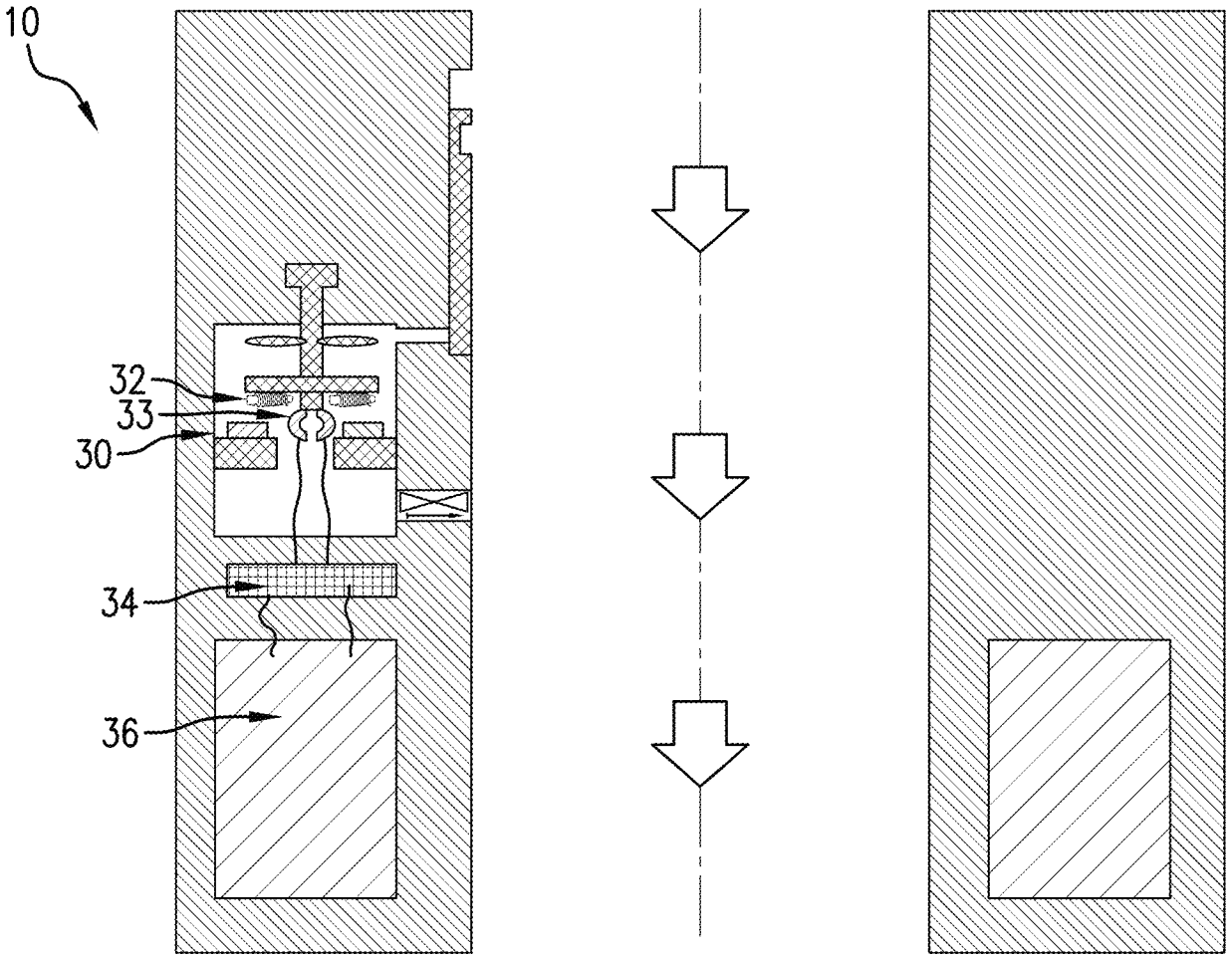
FIG. 4 is another embodiment of a sectional view of a disappear-on-demand material actuator in a static position before actuation.
Figure 5:
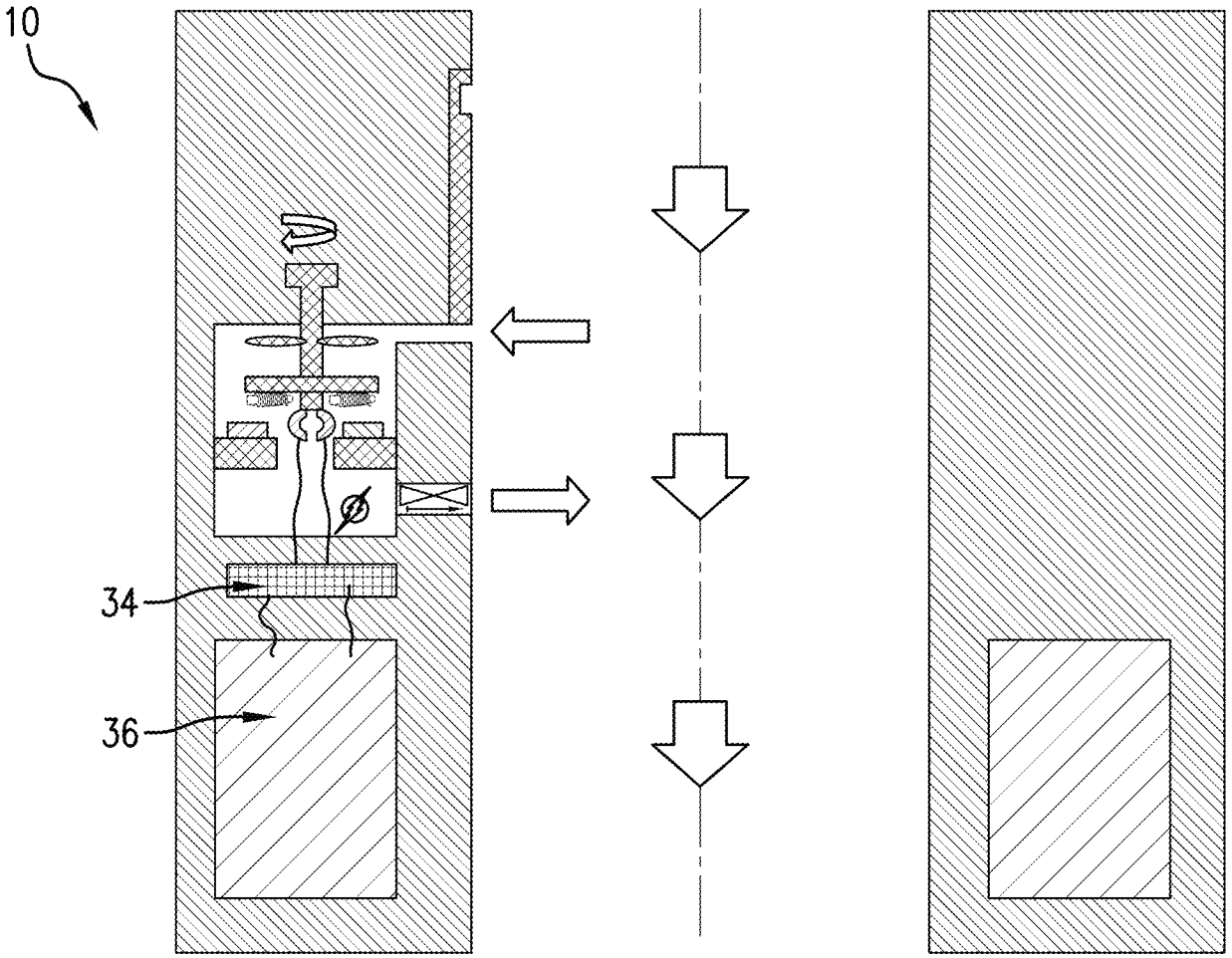
FIG. 5 is the view of FIG. 4 after a member has been moved to allow flow to spin a generator of the embodiment.
Figure 6:
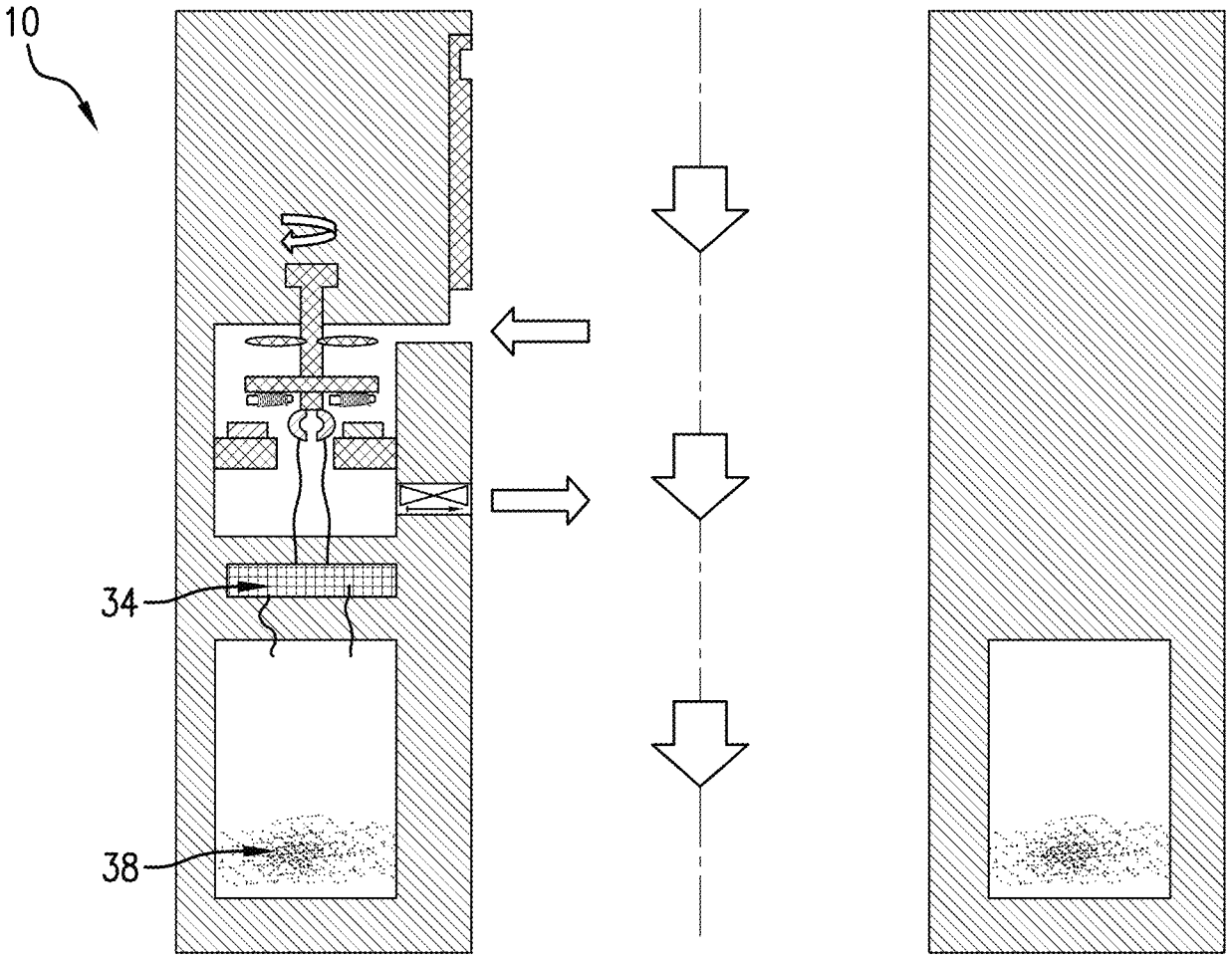
FIG. 6 is the view of FIG. 4 after the actuator has ignited the disappear-on-demand material.

Within chamber 20 is, in an embodiment, a turbine 26 that responds by spinning to the fluid flowing in to chamber 20 through port 18 and out one-way valve 24. The turbine spins an electromagnetic generator 28 that includes magnets 30 and coil(s) 32. The generator 28 may have rotary magnets 30 and stationary coil 32 (as shown in FIGS. 1-3) or may have stationary magnets 30 and rotary coils 32 (as shown in FIGS. 4-6 with the additional component of brushes 33). The coil(s) 32, whether rotary or stationary, in the embodiment of FIGS. 1-6 is/are connected to a voltage controlled switch 34 that only passes voltage after a threshold voltage that is set before use is achieved by the generator 28. The switch 34 is connected to a volume of disappear-on-demand (DOD) material 36 used as an impediment to actuation of an ultimate tool operationally connected to the actuator 10. When the trigger 16 is opened in the embodiment of FIGS. 1 and 3, establishing the flow through chamber 20, the turbine 26 will spin and drive the generator 28 to spin. When the generator spins fast enough to reach a threshold voltage output of 3V, or 5V, or similar desired value of voltage, the switch 34 will turn on and supply voltage to the DOD material 36, thereby igniting the same and causing it to disappear leaving only a small amount of ash 38 in its place. The DoD material disappearing can be used as an actuation event in several ways. The material could prior to igniting simply be a physical impediment to something else moving, or could be a structural member restraining something like collet fingers, etc.

Figure 7:
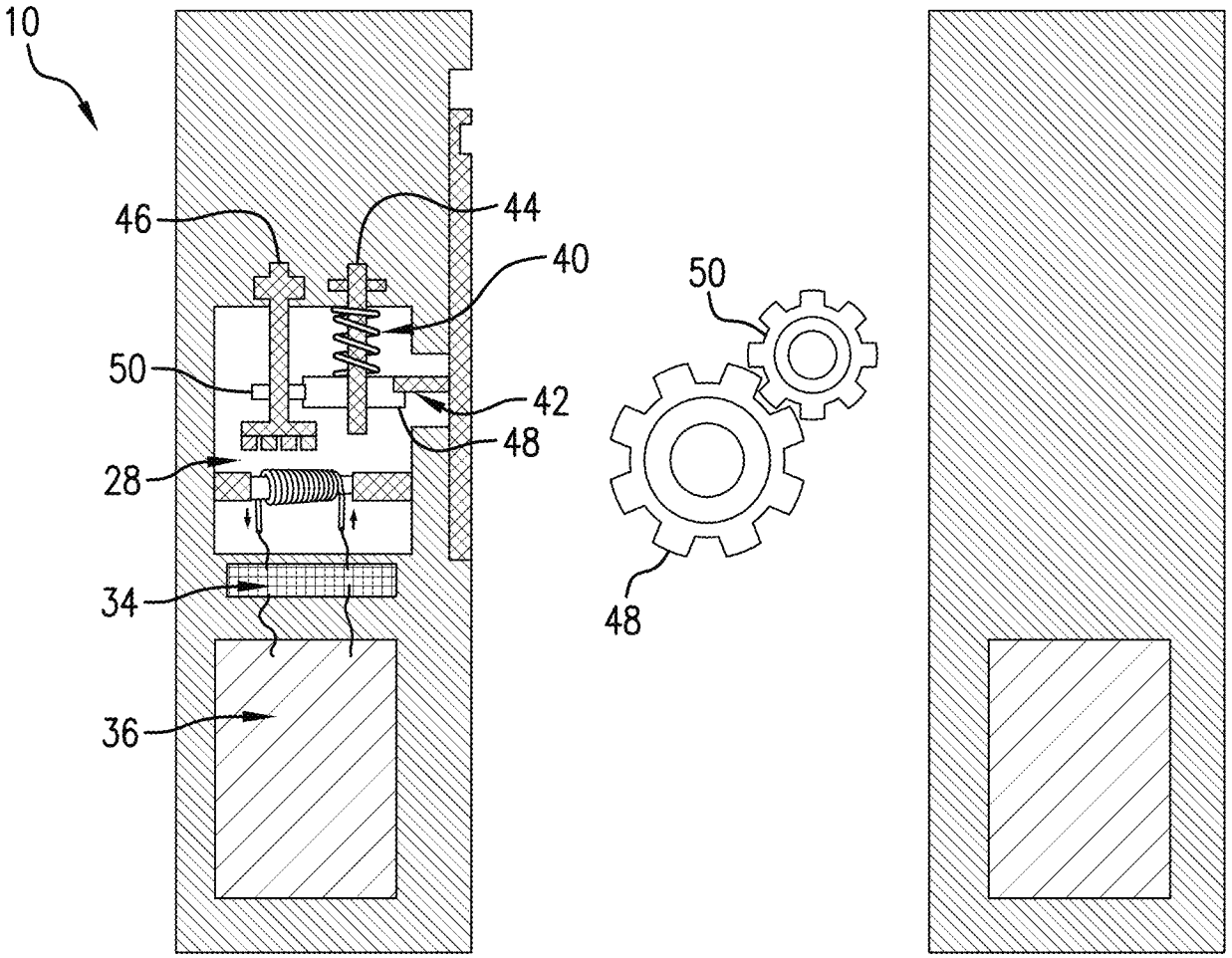
FIG. 7 is another embodiment of a sectional view of a disappear-on-demand material actuator in a static position before actuation.
Figure 8:
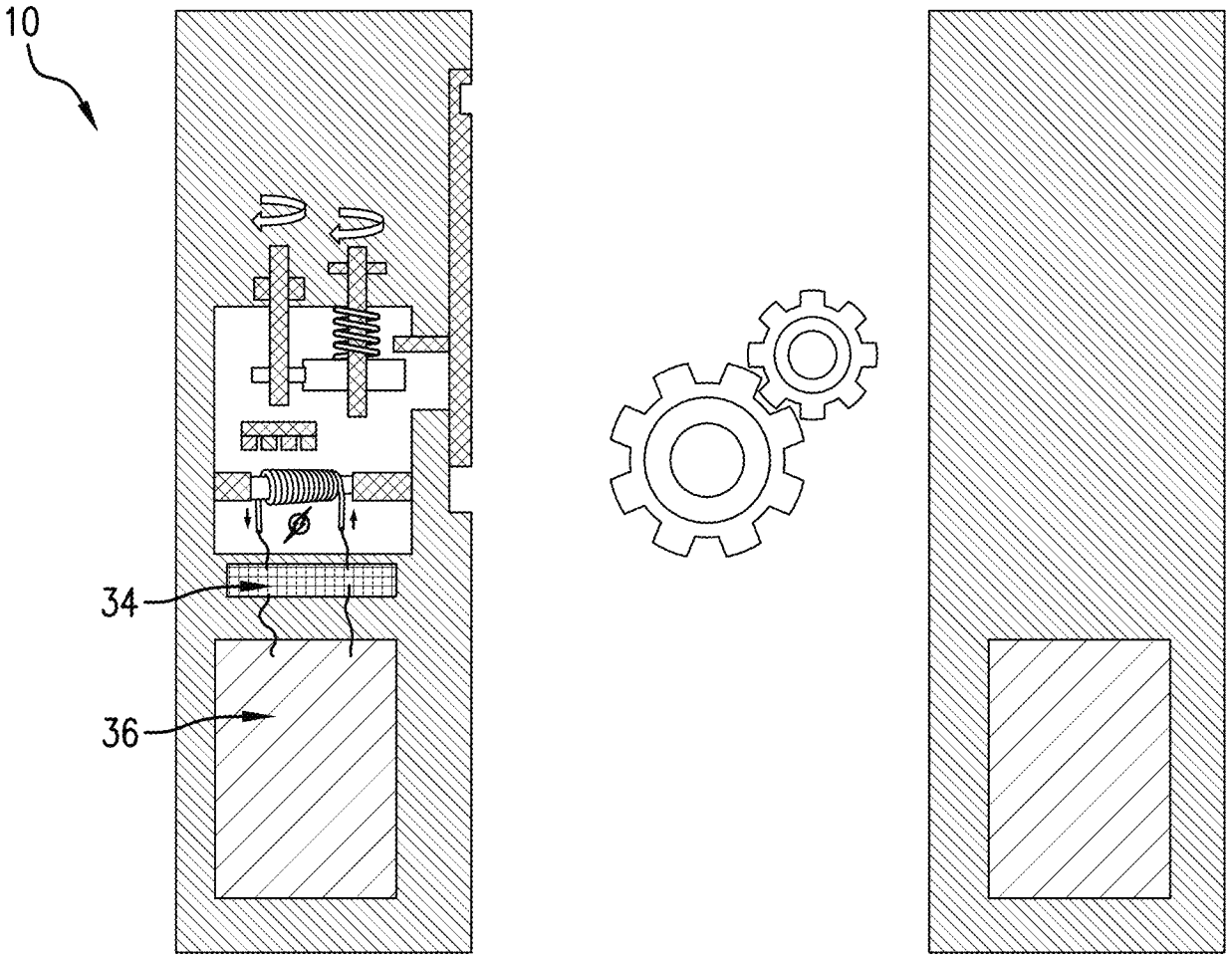
FIG. 8 is the view of FIG. 7 after a member has been moved to allow flow to spin a generator of the embodiment.
Figure 9:
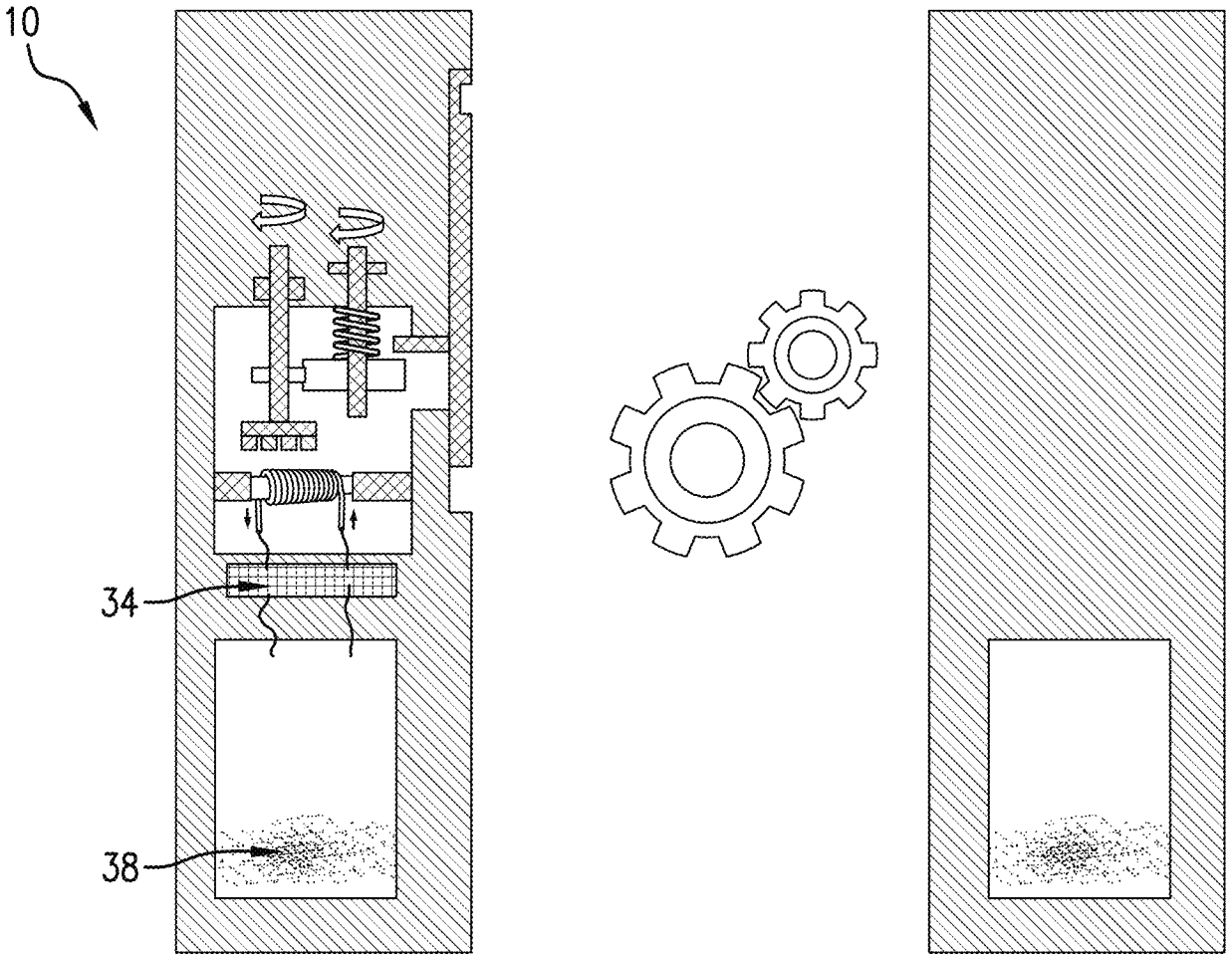
FIG. 9 is the view of FIG. 7 after the actuator has ignited the disappear-on-demand material.

In another embodiment, referring to FIGS. 7-9, the turbine 26 is replaced with a biaser 40. The biaser 40 is employed in a condition to store potential energy The energy may be input from the factory build of the actuator 10 or may be "wound" or otherwise input at the time of deployment. In either case, the potential energy of the biaser 40, which may be a compression spring, a tension spring, a torsion spring, etc., is used to spin the generator 28. Release of the potential energy of the biaser 40 is effected by manipulation of the string 12*c* as in the forgoing embodiment and simply moves a catch 42 so the biaser 40 may release the stored energy to become kinetic energy to spin the generator 28. As illustrated, there may be two shafts 44 and 46 with gearing 48 and 50 thereon to step up or step down the spin ratio created by the biaser 40. In other respects the generator 28 is similar to the foregoing embodiments. The switch 34 and DoD Material 36 are also similar.

A method for actuating a DOD material actuator is disclosed wherein intervention is avoided. Specifically, intervention means to run another string into the well in order to take an action somewhere inside the well. Causing actuation without an intervention is a time and cost saver and can be effected in accordance with the teachings herein by employing string manipulation to trigger the actuator 10

Figure 10:
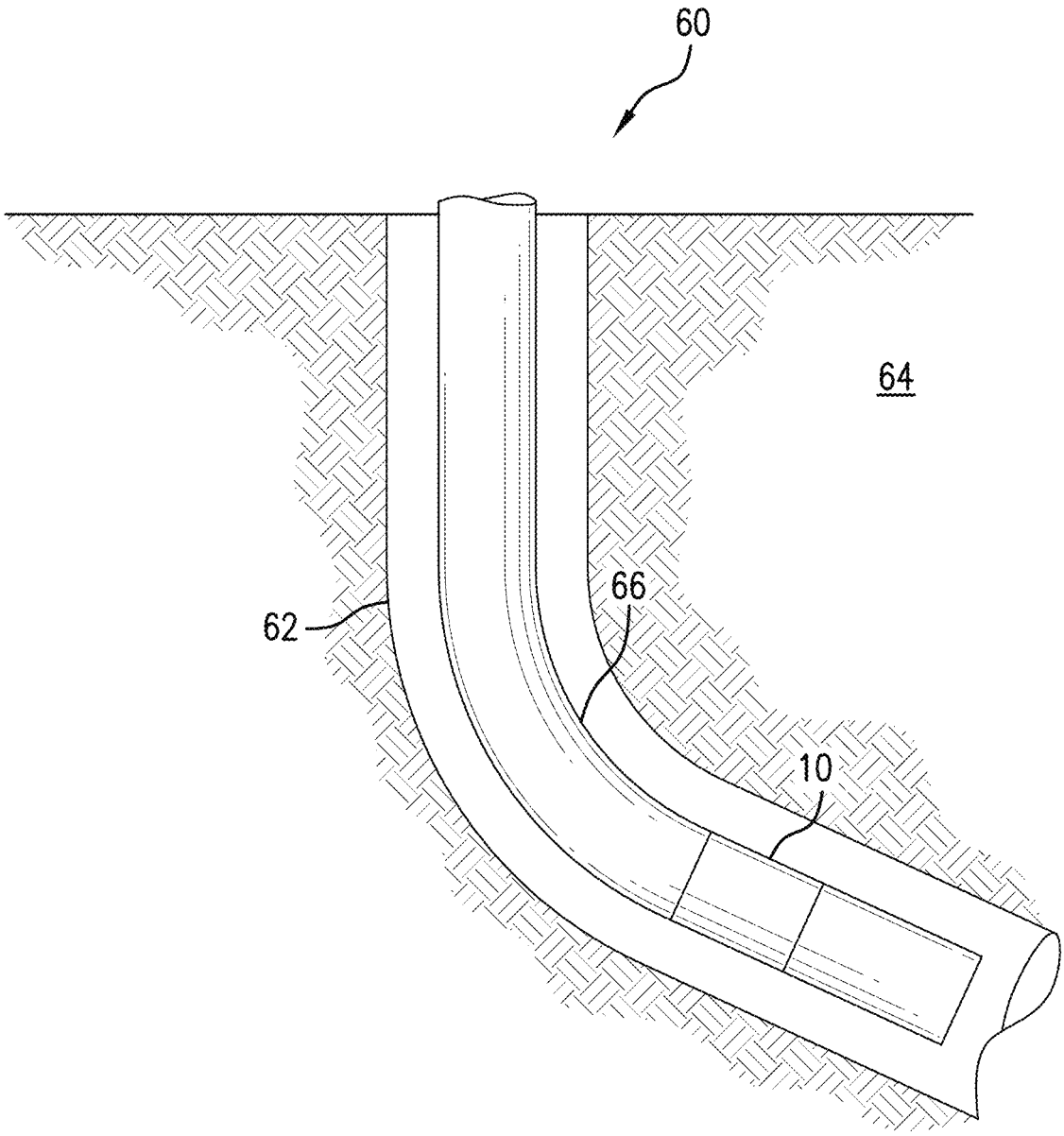
FIG. 10 is a view of a borehole system including disappear-on-demand material actuator as disclosed herein.

Referring to FIG. 10, a borehole system 60 is illustrated. The system 60 comprises a borehole 62 in a subsurface formation 64. A string 66 is disposed within the borehole 62. A DOD material actuator 10 as disclosed herein is disposed within or as a part of the string 66.

Set forth below are some embodiments of the foregoing disclosure:

Embodiment 1: A disappear-on-demand material actuator, including a trigger disposed in operable contact with the material, the trigger configured to respond to manipulation of a tubing string in operable communication with the actuator, and an electrical energy source electrically connected to the material and configured to supply electrical energy to the material upon a sequence initiation of the trigger.

Embodiment 2: The actuator as in any prior embodiment, wherein the trigger is a sliding sleeve.

Embodiment 3: The actuator as in any prior embodiment, wherein the trigger is a switch.

Embodiment 4: The actuator as in any prior embodiment, wherein the trigger is a controller.

Embodiment 5: The actuator as in any prior embodiment, wherein the electrical energy source is a battery.

Embodiment 6: The actuator as in any prior embodiment, wherein the electrical energy source is a generator.

Embodiment 7: The actuator as in any prior embodiment, wherein the generator includes magnets and coils.

Embodiment 8: The actuator as in any prior embodiment, wherein the actuator includes a drive operably connected to the generator.

Embodiment 9: The actuator as in any prior embodiment, wherein the drive is a turbine.

Embodiment 10: The actuator as in any prior embodiment, wherein the drive is a biaser.

Embodiment 11: The actuator as in any prior embodiment, wherein the biaser is a compression spring.

Embodiment 12: The actuator as in any prior embodiment, wherein the biaser is a torsion spring.

Embodiment 13: The actuator as in any prior embodiment, further including a voltage control switch.

Embodiment 14: The actuator as in any prior embodiment, wherein the voltage control switch measures a signal and upon reaching a threshold for the signal, facilitates passage of electrical energy to the material.

Embodiment 15: A method for actuating a disappear-on-demand material, including manipulating a tubing string, changing a trigger on the actuator as in any prior embodiment, and conveying electrical energy to the material.

Embodiment 16: The method as in any prior embodiment, wherein the changing includes sliding a sliding sleeve.

Embodiment 17: The method as in any prior embodiment, wherein the conveying electrical energy is from a battery.

Embodiment 18: The method as in any prior embodiment, further comprising generating electrical energy.

Embodiment 19: The method as in any prior embodiment, wherein the generating includes relatively moving coils and magnets to generate a current.

Embodiment 20: The method as in any prior embodiment, wherein the generating includes flowing of fluid through a turbine to drive a generator of the electrical energy.

Embodiment 21: The method as in any prior embodiment, wherein the flowing includes diverting a flow from a string with which the actuator is operably associated through the turbine.

Embodiment 22: The method as in any prior embodiment, wherein the generating includes releasing potential energy in a biaser to become kinetic energy used to generate the electrical energy.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" can include a range of +8% of a given value.

The teachings of the present disclosure may be used in a variety of well operations. These operations may involve using one or more treatment agents to treat a formation, the fluids resident in a formation, a borehole, and/or equipment in the borehole, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A disappear-on-demand material actuator, comprising:

a housing defining a chamber, the housing including a port fluidly communicating the chamber to an inside diameter of the housing and a one-way check valve fluidly communicating the chamber and the inside diameter of the housing the one-way check valve allowing fluid to flow in only one direction from the chamber to the inside diameter of the housing;

a configuration disposed radially inwardly of the housing that reduces flow in the inside diameter of the housing between the port and the one-way valve;

a trigger disposed adjacent the port, the trigger operable to open the port or block the port, and an electrical energy source disposed in the chamber, the source electrically connected to the material and configured to supply electrical energy to the material upon flowing of fluid through the chamber.

2. The actuator as claimed in claim 1, wherein the trigger is a sliding sleeve.

3. The actuator as claimed in claim 1, wherein the trigger is a switch.

4. The actuator as claimed in claim 1, wherein the trigger is a controller.

5. The actuator as claimed in claim 1, wherein the electrical energy source is a battery.

6. The actuator as claimed in claim 1, wherein the electrical energy source is a generator.

7. The actuator as claimed in claim 6, wherein the generator includes magnets and coils.

8. The actuator as claimed in claim 6, wherein the actuator includes a drive operably connected to the generator.

9. The actuator as claimed in claim 8, wherein the drive is a turbine.

10. The actuator as claimed in claim 8, wherein the drive is a biaser.

11. The actuator as claimed in claim 10, wherein the biaser is a compression spring.

12. The actuator as claimed in claim 10, wherein the biaser is a torsion spring.

13. The actuator as claimed in claim 1, further including a voltage control switch.

14. The actuator as claimed in claim 13, wherein the voltage control switch measures a signal and upon reaching a threshold for the signal, facilitates passage of electrical energy to the material.

15. A method for actuating a disappear-on-demand material, comprising:

manipulating a tubing string;

changing a trigger on the actuator as claimed in claim 1; and conveying electrical energy to the material.

16. The method as claimed in claim 15, wherein the changing includes sliding a sliding sleeve.

17. The method as claimed in claim 15, wherein the conveying electrical energy is from a battery.

18. The method as claimed in claim 15, further comprising generating electrical energy.

19. The method as claimed in claim 18, wherein the generating includes relatively moving coils and magnets to generate a current.

20. The method as claimed in claim 18, wherein the generating includes flowing of fluid through a turbine to drive a generator of the electrical energy.

21. The method as claimed in claim 20, wherein the flowing includes diverting a flow from a string with which the actuator is operably associated through the turbine.

22. The method as claimed in claim 18, wherein the generating includes releasing potential energy in a biaser to become kinetic energy used to generate the electrical energy.

23. A disappear-on-demand material actuator, comprising:

a housing defining a chamber;

a trigger disposed in the housing such that the trigger may be manipulated from within an inside diameter of the housing, the trigger including a catch;

a drive biased with potential energy and prevented from moving by the catch and movable following movement of the catch out of engagement therewith, the drive including a plurality of gears having a gear up or gear down ratio;

an electrical energy source disposed in the chamber, the source electrically connected to the material and configured to supply electrical energy to the material upon movement of the drive to initiate a disappear on demand reaction.

* * * * *